US007060987B2

(12) United States Patent
Lee et al.

(10) Patent No.: US 7,060,987 B2
(45) Date of Patent: Jun. 13, 2006

(54) ELECTRON IONIZATION SOURCE FOR OTHOGONAL ACCELERATION TIME-OF-FLIGHT MASS SPECTROMETRY

(75) Inventors: Edgar D. Lee, Highland, UT (US); Alan L. Rockwood, Provo, UT (US); Bingfang Yue, Provo, UT (US); Milton L. Lee, Pleasant Grove, UT (US)

(73) Assignee: Brigham Young University, Provo, UT (US)

( * ) Notice: Subject to any disclaimer, the term of this patent is extended or adjusted under 35 U.S.C. 154(b) by 0 days.

(21) Appl. No.: 10/793,689

(22) Filed: Mar. 3, 2004

(65) Prior Publication Data

US 2004/0238755 A1 Dec. 2, 2004

Related U.S. Application Data

(60) Provisional application No. 60/451,908, filed on Mar. 3, 2003.

(51) Int. Cl.
*H01J 27/00* (2006.01)

(52) U.S. Cl. ..... 250/423 R; 250/282; 250/287; 134/1.3; 134/1

(58) Field of Classification Search ..... 250/423 R, 250/282, 287; 134/1.3, 1
See application file for complete search history.

(56) References Cited

U.S. PATENT DOCUMENTS 5,849,093 A * 12/1998 Andra ..... 134/1.3
5,942,752 A 8/1999 Wang
2001/0030284 A1* 10/2001 Dresch et al. ..... 250/287
2004/0155180 A1* 8/2004 Zubarev ..... 250/281

FOREIGN PATENT DOCUMENTS

EP 0 878 828 A1 11/1998

OTHER PUBLICATIONS

Mingda Wang and Ed Cirimele; An Innovative El Ion Source for Mass Spectrometry; 2 pages; CSBU, Agilent Technology, Palo Alto, California.
A. Theodore Finkelstein; A High Efficiency Ion Source; book; Nov. 21, 1939; pp. 94 through97; vol. 11; Ithaca, New York.
M. DeKieviet, D. Dubbers, M. Klein, U. Pieles and C. Schmidt; Design and performance of a highly efficient mass spectrometer for molecular beams; May 2000, 4 pages; vol. 71, No. 5; Heidelberg, Germany.
C. E. Carlston and G. D. Magnuson; The Review of Scientific Instruments; Sep. 1962; pp. 905 to 911; vol. 33, No. 9; San Diego, California.

* cited by examiner

*Primary Examiner*—Nikita Wells
*Assistant Examiner*—Zia R. Hashmi
(74) *Attorney, Agent, or Firm*—Morriss O'Bryant Compagni

(57) ABSTRACT

A radio-frequency quadrupole ion guide having a symmetrical magnetic field disposed along an axis of the ion guide, wherein the system provides prolonged interaction between electrons and uncharged compounds within an ionization volume of the ion guide, resulting in enhanced ion creation.

69 Claims, 13 Drawing Sheets

(a) (b)

ELECTRON IONIZATION SOURCE FOR OTHOGONAL ACCELERATION TIME-OF-FLIGHT MASS SPECTROMETRY

PRIORITY CLAIM

This application claims priority to the provisional application titled NOVEL ELECTRON IONIZATION SOURCE FOR OTHOGONAL ACCELERATION TIME-OF-FLIGHT MASS SPECTROMETRY, filed Mar. 3, 2003, having Ser. No. 60/451,908.

BACKGROUND OF THE INVENTION

1. Field of the Invention

This invention relates generally to the creation of ions within an ion guide. More specifically, the present invention superimposes a symmetrical magnetic field around an ion guide to thereby prolong interaction between electrons, uncharged compounds, charged compounds, resulting in enhanced ion creation.

2. Description of Related Art

The relevant state of the art in the production of gas phase ions requires examination of both electron ionization and chemical ionization. In general, ionization is used for many purposes, including providing a continuous stream of ions, trapping and confining ions for pulsed production, and functioning as a source of first ions that generate secondary ions. Gas phase ions are often created in order to perform some type of analysis, such as in an ion mobility analyzer, a mass analyzer, and a secondary ion mass spectrometer.

It is useful to look at a specific example of how ionization is performed and used in order to understand the advantages of the present invention. Accordingly, the deficiencies inherent in ionization sources when used with a mass analyzer will be explained.

The principle of mass spectrometry (MS) is the production of gas phase ions that are subsequently separated and detected according to their m/z values. A mass spectrometer consists of five basic parts: sample introduction system, ionization source, mass analyzer, ion detector, and a data acquisition/handling system. While there are many different techniques to accomplish ionization, the most widely used technique is electron ionization (EI) due to its high sensitivity, ease of generating high electron emission current, approximately uniform ionization yield for most analytes; rich structural information in resulting mass spectra, and extensive 70 eV EI mass spectral libraries that enable spectral matching and compound identification.

EI sources have been extensively investigated and various designs have been published and converted into commercial products. Most EI sources are based on the design of Nier. Electrons from an electrically heated filament (cathode) are accelerated by a potential difference between the filament and the source enclosure, and pass through the entrance and exit apertures in the source body. This electron beam penetrates a sample vapor at reduced pressure in the source volume. In most cases, the approach of an energetic electron near an analyte molecule leaves the molecule with a positive charge as the exchange of energy results in the ejection of an electron from the molecule. The dimensions of the electron beam determine the ionization volume in which ions can be formed. Ionization takes place only in the area of the gas flow that is traversed by the electron beam, so that the number of ions formed is relatively small. Moreover, only some of these ions can then be channeled by additional focusing into the mass analyzer.

Because ion source efficiency is the main factor limiting sensitivity in many types of mass spectrometers, many applications of MS are determined in large part by this efficiency; therefore, it is important to study means for improvement of ionization efficiency.

One technique to improve ionization efficiency is to increase the sample pressure and thereby increase the density of molecules in the ionization region. Higher pressure in a small source volume will provide more effective use of the sample. Another technique is to increase the electron emission by heating the filament to a higher temperature, thus, increasing the number of electrons entering the ion source. However, both methods have the disadvantage of decreasing filament lifetime. The former may also require isolation and increased pumping of the mass analyzer region to avoid degradation of analyzer performance due to ion/molecule interaction. The latter process cannot be continued indefinitely because the cloud of electrons formed above the hot filament surface reduces the emission efficiency due to space charge effects.

Ionization can also be enhanced in a number of other ways. One approach is to utilize the ionizing electrons as efficiently as possible. The electron beam can be focused into the ionization volume by the use of an electron repeller positioned behind the filament that is electrically connected to a more negative potential than the filament bias voltage. The electrons can also be reused by reflecting them back and forth many times in the potential well established between the negatively biased cathode and anode, allowing the electrons a greater opportunity to interact with sample molecules. A weak collimating magnetic field can be applied parallel to the electron beam axis, and the field strength can be chosen to provide high transmission of electrons with minimal perturbation of the ion beam. A field of 100 gauss is typically used. The magnetic field can cause electrons to follow a helical trajectory around the magnetic field lines, thereby increasing the effective electron ionization path length L and ionization probability.

Simulation of ion trajectories has led to improved source geometry and optimum electrode potentials to produce a focusing electric field inside the source volume, which effectively allows sampling from a larger ionization volume and leads to higher ion extraction efficiency. Usually, the ion source contains a series of ion optics to draw out, focus, and inject ions into the mass analyzer.

Recently, EI sources have been designed with large dimensions, especially for use with atomic or molecular beams. Electrons can be focused by using either a magnetic or an electric field. One prior art described an EI source that had a separate electron-generating chamber in which electrons were generated completely around, directed toward, and deflected longitudinally along the instrument axis and into the ionization chamber. The electron trajectories overlapped with the profile of gas flow along the source axis. This resulted in a much longer contact between the electrons and the gas. The generated ions were forced into a cylindrical beam of relatively small diameter.

Similarly, another reference teaches a cylindrically symmetric magnetic field that compressed electrons emitted from a large filament into a long narrow volume containing primarily the molecule beam. This has the advantage of both producing little background from residual gas and increasing the interaction region between the ionizing electron beam and the molecular beam. Experiments using thermal helium atoms showed very high efficiency and sensitivity.

Another interesting approach is internal ionization using an electron beam in a Paul ion trap. The electron beam is introduced inside the ion trap to ionize the sample molecules. The instrument sensitivity resulting from internal ionization can be high because all of the ions in a solid angle can be confined and detected.

Recently, an ion source consisting of four electrodes which create an approximate radio frequency (RF) quadrupole field in the center of the ionization volume was designed to enhance ion source performance for a quadrupole mass spectrometer. Background ions of low m/z, such as helium ions, could be ejected immediately after formation. Meanwhile, sample ions were focused toward the z-axis by the RF electric field by collisional cooling while moving toward the exit. A ten-fold increase in signal-to-noise (S/N) ratio (compared to a traditional ion source) was claimed by the authors. It is noted that RF should not be considered to be limited to those frequencies typically associated with radio waves. Those skilled in the art understand that RF includes a much broader range of frequencies.

The renaissance of time-of-flight mass spectrometry (TOFMS) can be primarily attributed to the development of two new ionization methods, matrix-assisted laser desorption ionization and electrospray ionization. TOFMS has several features that are particularly useful for analysis of large bio-molecules. First, the m/z range is theoretically unlimited. Second, no defining slits are needed and ions can be detected over the complete m/z range at the same time without scanning. Early TOFMS instruments suffered from poor resolution; however, electrostatic reflectors, orthogonal acceleration, and the rediscovery of the benefits of delayed extraction have led to substantial improvements in resolution. Consequently, TOFMS instruments now provide, in most cases, optimum combination of resolution, sensitivity, and speed, particularly under conditions in which the entire mass spectrum is required.

In contrast to pulsed ionization sources, there are difficulties in coupling any continuous source to a TOFMS instrument, including the EI source. A TOFMS instrument must be pulsed in some way, as there needs to be a reference (or well-defined start time) in order to deduce a flight time from the detected ion arrival time. Thus, the main challenge in coupling continuous ion sources is producing temporary discrete ion packets, either by pulsing the source or gating the ion beam. This imposes a serious limitation in ion sampling efficiency or duty cycle (i.e., ratio of ions detected to ions formed). Sometimes, exaggerated claims are made with regard to sensitivity of TOFMS instruments compared to scanning mass spectrometers when more than one mass is observed. Few approaches for coupling EI sources to TOFMS have yielded sufficient resolving power, sensitivity, and fidelity of ion abundances when compared to mass spectral libraries.

Combining an ion trap with orthogonal acceleration TOFMS has so far proven to be an effective method to greatly improve the duty cycle. An in-line ion-trap storage/TOFMS instrument in which ions could be either externally injected into (or internally formed in) a quadrupole ion trap has been shown in the prior art. This approach provided the potential for nearly 100% duty cycle in converting a continuous ion beam into a pulsed source for TOFMS. However, a cooling step was required, ions with a wide energy spread were ejected, it had limited charge capacity and trapping efficiency, and there was difficulty in ejection of ions at a high repetition rate.

Quadrupole, cylindrical, and segmented ring cylindrical ion traps have all been interfaced to TOFMS. In one study an ion trap El source was designed in which two thin diaphragms made up a segmented ring electrode and the end cap electrodes were constructed of planar wire mesh. The potential field produced by the RF voltage resembled that of a cylindrical ion trap. The linear extraction field enabled good resolution without the need for ion cooling prior to mass analysis. However, it was important to find the best RF phase to initiate extraction. Furthermore, with EI in the ion trap, the filament bias voltage was not a direct measure of the ionizing electron energy because of the large effect of the RF field on the electron trajectories. Nevertheless, an ion trap/TOFMS using an EI source was developed for real time monitoring of trace volatile and semi-volatile compounds in air. An ion storage time of 400 ms limited the maximum spectral acquisition rate and made it unsuitable for fast on-line separations. The possibility of coupling an ion trap and orthogonal acceleration TOFMS was also studied. Because of the wide ranges in ion velocities and ejection times, the triggering between the ion trap and orthogonal acceleration TOFMS was impossible for full mass spectral acquisition.

Orthogonal acceleration provides a high efficiency interface for converting ions from a continuous beam into segmented ion packets. This instrument offers high sensitivity at the high mass end of the spectrum. It should be noted that most of the ion sources used in prior art references were originally designed for quadrupole or magnetic sector instruments. Because they were not optimized for orthogonal acceleration TOFMS, they provided relatively low ion transmission efficiency and necessitated the use of complex ion optics to manipulate the ion beam.

Accordingly, what is needed is an ionization source that provides improved ionization efficiency from efficient use of electrons and a nontraditionally large ionization volume. This system should function as an ion source for many different applications, and should work with both electron and chemical ionization in a continuous and pulsed mode of operation.

BRIEF SUMMARY OF THE INVENTION

It is an object of the present invention to provide an ionization source that has an efficient ionization process.

It is another object to provide an ionization source that will function with electron and chemical ionization processes.

It is another object to provide an ionization source that can function as an ion source for many different applications, including analysis using an ion mobility analyzer, a mass analyzer, and a secondary ion mass spectrometer.

It is another object to provide an ionization source that operates in both a continuous and pulsed mode of operation.

In a preferred embodiment, the present invention is a radio-frequency quadrupole ion guide having a symmetrical magnetic field disposed along an axis of the ion guide, wherein the system provides prolonged interaction between electrons and uncharged compounds within an ionization volume of the ion guide, resulting in enhanced ion creation.

These and other objects, features, advantages and alternative aspects of the present invention will become apparent to those skilled in the art from a consideration of the following detailed description taken in combination with the accompanying drawings.

DETAILED DESCRIPTION OF THE INVENTION

Reference will now be made to the drawings in which the various elements of the present invention will be given numerical designations and in which the invention will be discussed so as to enable one skilled in the art to make and use the invention. It is to be understood that the following description is only exemplary of the principles of the present invention, and should not be viewed as narrowing the claims which follow.

It is important to remember that the ionization source of the present invention is capable of functioning as an enhanced ion source for any applications requiring gas phase ions. Furthermore, the ions can be initially generated from many different sources. These sources include any appropriate ion sources or beta emitters, such as an electron gun, a hot filament, a discharge needle, or by radioactive decay of a radioactive material. The present invention also provides its benefits for both electron and chemical ionization sources.

Figure 1:
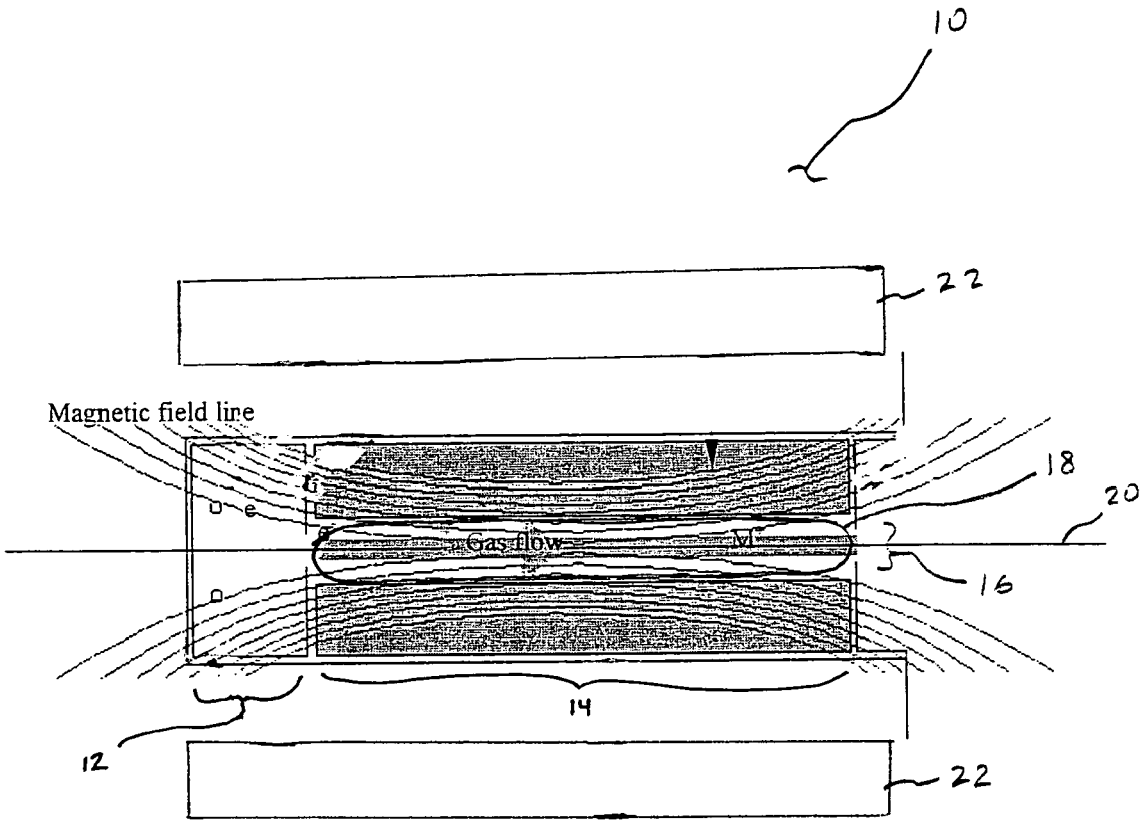
FIG. 1 is a cut-away illustration of an electron ion source of the present invention.

FIG. 1 is provided as a cut-away illustration of an electron ion source of the present invention. The electron source 10 consists of a filament assembly 12, a quadrupole assembly 14 (which is only one example of an RF-only ion guide), a magnetic field source 22, and an exit lens 16. The volume 18 inside the quadrupole assembly 14 serves as the ionization chamber as well as an ion guide, and the quadrupole assembly is operated in the RF-only mode.

The magnetic field source 22 must be a symmetrical source in order to generate the required magnetic fields. The magnetic field source 22 can be a single cylindrical magnetic source, or be comprised of several discrete magnetic sources that are arranged in so as to generate a symmetrical magnetic field. In the preferred embodiment, the single magnetic field source is a cylindrical permanent magnet. Alternatively, the magnetic source can be comprised of several permanent bar magnets. Furthermore, the magnetic field source 22 can be generated by one or a plurality of electromagnets.

Figure 2:
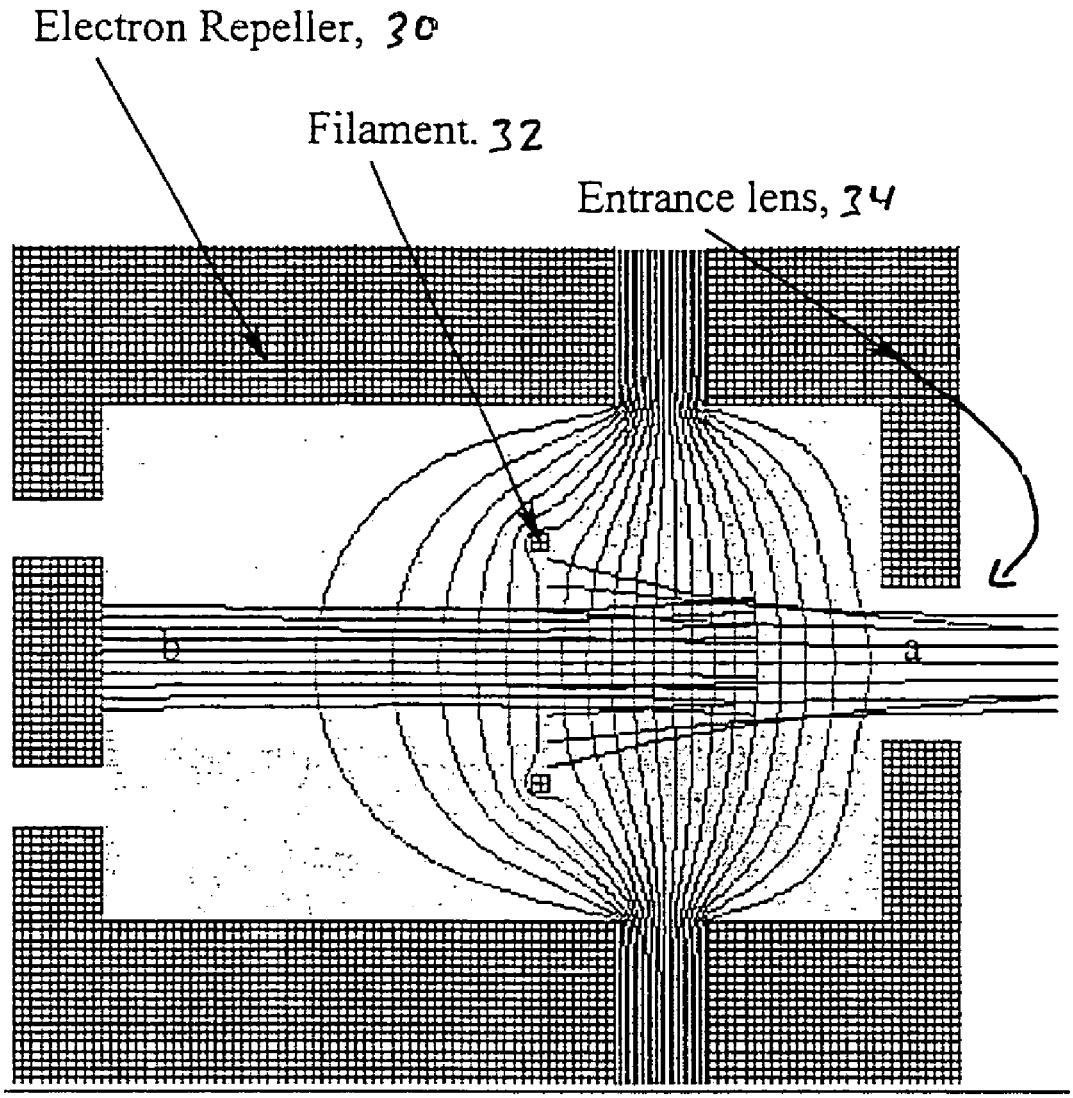
FIG. 2 is a close-up cut-away view of the filament assembly.

FIG. 2 is a close-up cut-away view of the filament assembly 12. The filament assembly 12 includes an electron repeller 30, a large ring-shape filament 32, and the quadrupole entrance lens 34, which also serves as an ion repeller electrode similar to a Nier-type source. Electrons created at the filament 32 are accelerated by the potential difference between the filament and the entrance lens 34. These electrons are on-axis to the RF quadrupole assembly 14 and penetrate the full length of the quadrupole assembly when both electric and magnetic fields are applied to the RF quadrupole assembly.

The voltage along a long axis 20 (FIG. 1) of the quadrupole assembly 14 axis is time-invariant, and the RF field causes small fluctuations in the voltage close to the long axis. Sample gas is introduced into the quadrupole assembly 14. The trajectories of the electron beam overlap with the profile of the sample gas flow, leading to ionization of the sample gas in the large volume 18 defined by the length and inscribed radius of the quadrupole assembly 14. Ions are focused radially by the RF field of the quadrupole assembly 14, and then axially extracted for mass analysis. It should be remembered, however, that the ions can be confined within the ionization volume 18, and released under a pulsed mode of operation.

Although the basics of all ion source designs draw upon fundamental principles, the quantitative performance of the present invention depends upon the interaction of many subtle design characteristics. The unique features of this new ionization source are now discussed.

Stability and sensitivity are important characteristics of ion source design, as well as filament lifetime. There are several problems associated with filament assemblies used in electron or chemical ionization of the prior art. First, the filament produces heat that may cause sublimation of the refractory metal of the filament, leading to premature failure. Second, ions formed between the filament and the ionization chamber may bombard the filament, sputtering metal off the filament and shortening its lifetime.

Our filament assembly design solves these problems and better utilizes the electrons emitted from the filament. The cylindrical symmetry enables the use of the large ring-shaped filament 32. Simulated electrostatic field lines of the filament assembly 12 are shown in FIG. 2. The electric field as illustrated, in combination with the magnetic field (discussed next), focuses and compresses the electron beam toward the opening in the entrance lens 34. A high percentage of emitted electrons enter the ionization volume 18 inside the quadrupole assembly 14 and pass through an ionization region. In addition, ions that are formed between the filament 32 and the entrance lens 34 are accelerated by the same electric field towards the electron repeller 30 without sputtering the filament 32 itself. Moreover, since the electrons are emitted from a large surface area, the same amount of emission current can be obtained at a lower filament current and, thus, the ion source temperature is more uniform and better controlled than in a conventional EI source.

The design of the present invention is very suitable for high-pressure ion source operation. Also, the gas sample is isolated from the filament 32 and sample degradation on the hot filament 32 is eliminated. The combination of these new features of the present invention result in long filament lifetime and high sensitivity.

A weak magnetic field is a typical component of most electron ionization sources. The magnetic field primarily helps to radially focus the electron beam in order to provide better transmission and to cause electrons to follow a helical path and, thus, longer ionizing path length. However, in the case of high emission current, charge repulsion within the electron cloud limits the ionization efficiency. In practice of the present invention, a stronger magnetic field increases the limit of emission current at which space charge occurs.

The magnetic field in the new source 10 of the present invention serves two additional purposes if the proper field profile is generated as shown in FIG. 1. First, the magnetic flux must converge in the filament assembly 12 to focus electrons into a tight beam. The effect of the magnetic field on electrons is much greater than the effect of the electric field because the force of the magnetic field is proportional to electron velocity since electrons have such small mass. Electrons basically gyrate around and follow the magnetic lines in cyclotron-type motion. More importantly, in the quadrupole assembly 14, the parallel magnetic field lines assist electrons in penetrating the full depth of the ionization volume 18 and keeping their energy constant. Therefore, the magnetic field must be strong enough to eliminate the detrimental effects of the radial RF field on the electrons without perturbing ion focusing.

Figure 3:
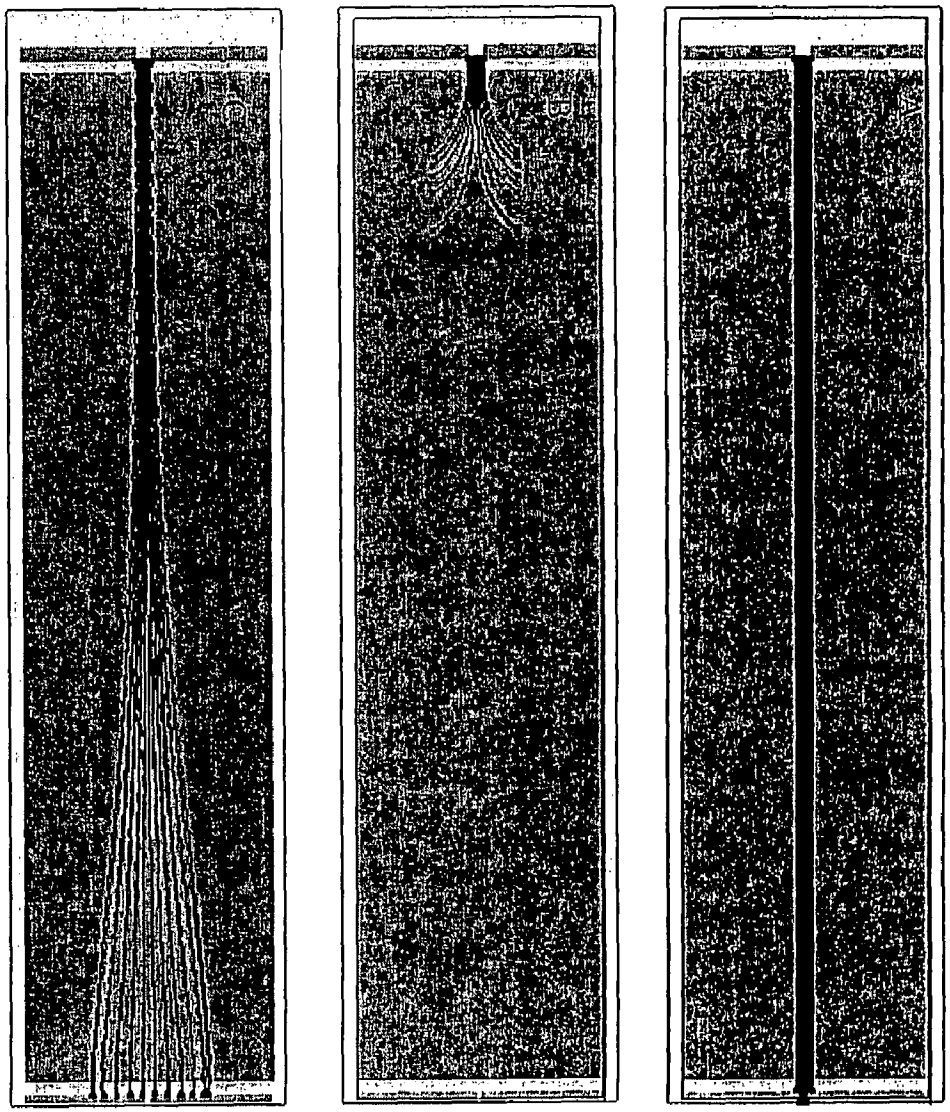
FIG. 3 is a cut-away illustration showing that electrons are greatly constricted to the quadrupole axis even in the presence of high RF voltage.

It only takes 0.0157 μs for an electron of 70 eV to cover a distance of 78.2 mm (the quadrupole rods are 76.2 mm long with a ceramic spacer of 1 mm on each end) in field-free space. This is only 2.75% of the period of RF voltage of 1.75 MHz frequency. This means that the alternating RF field is not fast enough for electrons, and electrons "see" the RF field as an electrostatic field. The electrons acquire radial kinetic energy while being accelerated toward the quadrupole rods. The penetration depth into the quadrupole and the electron kinetic energy at the moment of molecule ionization depend on the RF voltage and phase, as well as the kinetic energy and radial position of electrons at the time of entry. The RF voltage leads to short residence time and penetration depth, and high kinetic energy (as shown in Table 1). Also shown in FIG. 3 is that electrons are restricted to the vicinity of the entrance. Thus, both qualitative and quantitative performance are compromised due to small ionization volume and large variation in electron energy.

Figure 4:
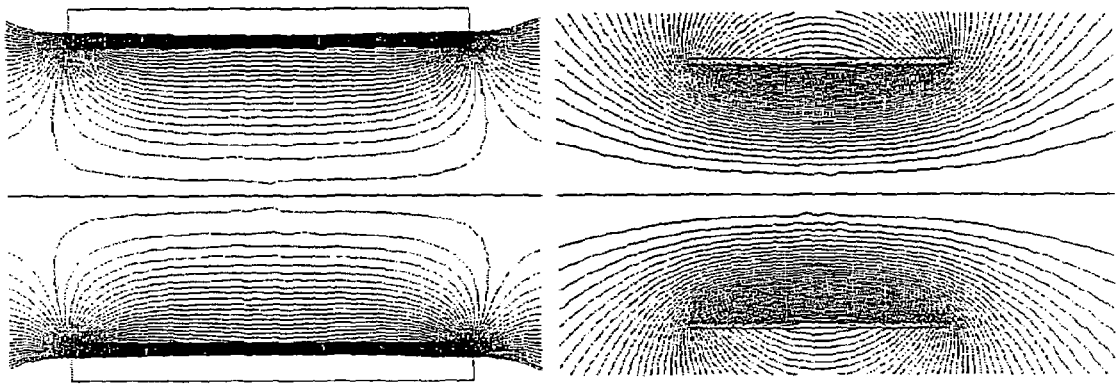
FIG. 4 illustrates a cut-away view of flux lines generated by two types of magnets.

A strong, static magnetic field with flux lines parallel to the quadrupole axis 20 can solve the problems described above. As illustrated in FIG. 3, under a magnetic field of 500 gauss, electrons are greatly constricted to the quadrupole axis even in the presence of high RF voltage. Table I shows that electrons are able to penetrate the full length of the quadrupole and maintain almost constant kinetic energy (i.e., shifted only 3% relative to the field-free case, which is qualitatively very important for MS). The magnetic field required for the source design can be easily achieved by using an electromagnet or a permanent magnet. The flux lines generated by these two types of magnets are shown modeled in FIG. 4. Both magnets are capable of providing the required field profile and field strength if designed properly. One problem using an electromagnet is the large amount of heat generated, especially under vacuum conditions.

Simulations also show that the magnetic field has little effect on ion transmission and focusing, especially under elevated pressure conditions (data not shown). This can be explained by the high masses of ions compared to electrons. The effect of the magnetic field on ion motion in an RF-only quadrupole is to add a new term to the equations of motion in the radial direction. In this new term, the acceleration by the magnetic field equals $v_r \cdot B_z/(m/z)$, in which $v_r$ is the ion's velocity component normal to the magnetic field $B_z$ and m/z is the ion's mass-to-charge ratio. In addition to the relatively high masses of ions compared to electrons, ions formed close to the axis inside the quadrupole have very low radial kinetic energy at the time of formation. Thus, the acceleration term should be negligible. It should also be noted that a static magnetic field only changes an ion's direction of motion but not its kinetic energy.

Regarding RF only devices, using an RF-only device as an ion guide or linear ion trap is well known for improved ion transmission, especially at elevated pressure in API interfaces. This is the result of collisional cooling and focusing. Indeed, the RF field creates a two-dimensional pseudo-potential (or effective potential) well perpendicular to the device axis, and the radial ion motion can be modeled as motion in an effective harmonic trapping potential. Multiple collisions with molecules of the buffer gas reduce their radial kinetic energies to near thermal values, and cause them to move to the minimum of the effective potential on the device axis. Ions are therefore more efficiently transmitted through the exit aperture. The ions also lose a large fraction of their axial translational energy and leave the RF device with low energy as well as low energy spread (a few eV or less).

Also, to a certain extent, increasing the pressure of the helium dampening gas in a three-dimensional quadrupole ion trap leads to enhanced sensitivity, high mass resolution, and $MS^n$ capability. In addition, the helium buffer gas pressure in the quadrupole ion trap has little effect on fragmentation during ion injection.

In the embodiments of the present invention, a number of different RF devices can be used, providing that the RF device can offer radial focusing in a volume, such as with multi-pole and stacked ring ion guides. These linear or two-dimensional ion traps have advantages of high charge capacity and improved ion trapping efficiency compared to three-dimensional quadrupole ion traps. The advantage of the present invention with internal ionization is that ions only need to be focused radially and can be ejected continuously and simply.

Because of axial collisional dampening, the average transit time of an ion through a multi-pole ion guide in an API interface or collision cell turns out to be on the scale of milliseconds in the absence of an axial electric field. In contrast, in the present invention the ions formed directly in a 2D RF ion guide possess only thermal kinetic energy at the moment of formation. Although there are axial fringing fields close to both the entrance and exit lens, they aid ion extraction when there is positive voltage on the entrance lens 34 and negative voltage on the exit lens 18. However, the fringing fields mainly operate near the ends of the ion guide and are very inefficient for ions near the axial center of the ion guide. To overcome axial collisional dampening, an axial electric field is needed to move ions efficiently through the ion guide.

Various designs of an RF-only ion guide possessing an axial field have been reported, including conical, tilted, or segmented rod geometry, and addition of extra electrodes. Application of an axial field results in ions experiencing a continuous acceleration as they travel through the ion guide, so that even thermal ions continue to travel down the potential gradient thus created. In all cases, relatively low axial fields have been shown experimentally to considerably reduce the transit time.

Figure 5:
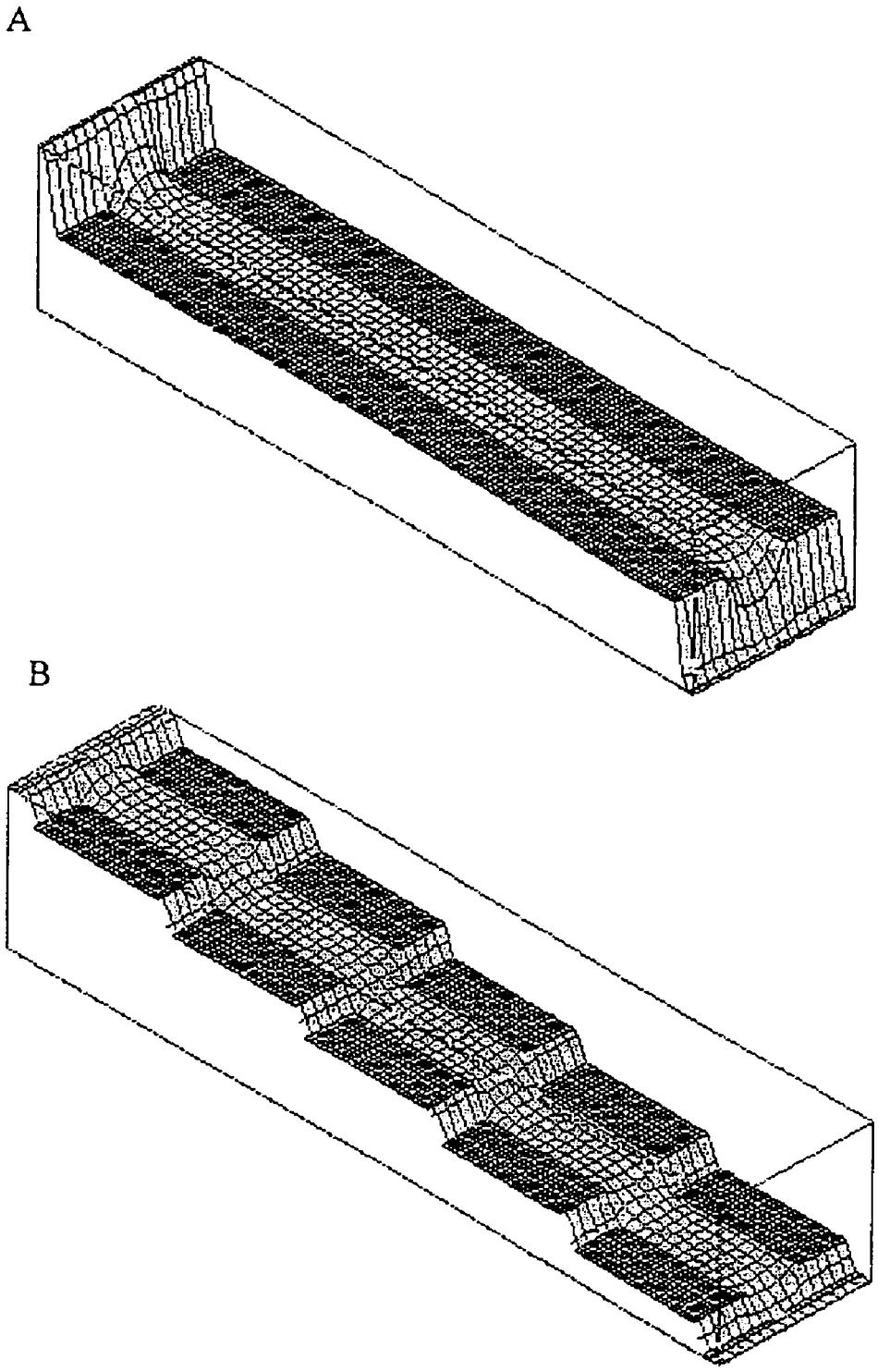
FIG. 5A illustrates axial electric fields are compared for single quadrupoles.
FIG. 5B illustrates axial electric fields are compared for segmented quadrupoles

In FIG. 5, the axial electric fields are compared for single and segmented quadrupoles. FIG. 5(*a*) illustrates a small axial DC field gradient due to field penetration into the quadrupole. In most of the center volume of a single quadrupole, there is no axial field gradient. In the case of segmented rods, a linear potential energy can be achieved using short rod segments.

An important advantage can be realized using a continuous E1 source with pulsed extraction over a pulsed source in which the electron beam must be switched on and off to generate ions in pulses. Using the new ion source described by the present invention, the duty cycle of orthogonal acceleration was improved by trapping ions that were continuously formed and then gating them in short bursts into the acceleration region of the orthogonal extraction of the TOFMS.

Linear traps are currently used primarily as ion storage devices for subsequent mass spectrometric measurements. Ion accumulation in a linear ion trap can be considered essentially as a one-dimensional problem for which the radial RF field (and dampening gas) prevents ions from leaving the trap in the radial direction. It is simple to trap ions by raising the potential applied to the entrance and exit lens or lowering the offset potential on the ion guide to form an axial potential well. Since ions are directly formed inside the ion guide, they possess low thermal kinetic energy at the moment of formation and a shallow potential well is enough to trap them before the extraction field is applied. This is different from trapping externally generated ions in that the latter necessitates an energy dissipation process, which is often pressure dependent collisional dampening.

Figure 6:
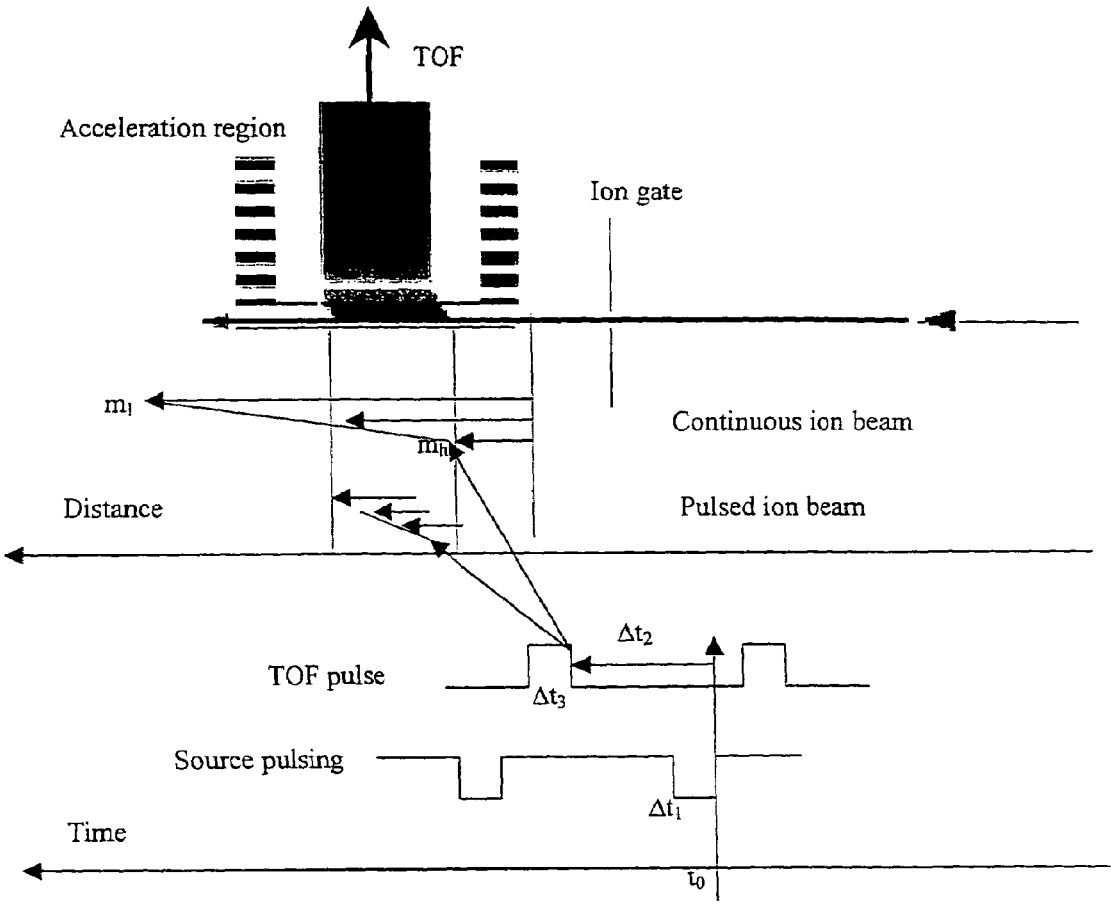
FIG. 6 illustrates the concept that an ion beam fills the acceleration region between two TOF pulses with most $m_l$ ions passing through and no $m_h$ (high m/z) ions entering the detection window.

In a continuous ion beam orthogonal acceleration TOFMS, the ion beam fills the acceleration region between two TOF pulses with most $m_l$ (low m/z) ions passing through and no $m_h$ (high m/z) ions entering the detection window as shown in FIG. 6. Moreover, no ions are loaded during the TOF pulse period, thus reducing the duty cycle. Consequently, the duty cycle is low and m/z dependent. In contrast, it is possible to detect all ions in a particular m/z range by pulsing the ion beam out of the trap and into the orthogonal acceleration TOFMS. At time $t_0$, the ion gate is opened with a negative pulse for a short period of time $\Delta t_1$, during which ions can leave the source. After a time delay of $\Delta t_2$, all ions leaving the source reach the detection window. Then, a positive TOF extraction pulse of $\Delta t_3$ is applied to accelerate ions into the flight tube. Ions outside the optimal mass range can still be detected with a lower duty cycle. By switching the voltage on the exit lens between a high and low setting, the source can be operated in a trap-and-release mode.

To achieve a reasonable mass range for an EI source with near 100% duty cycle, the pulsing voltages, width of the gating pulse, and timing between the gating pulse and the TOF pulse must be properly controlled to ensure that the trajectories of ions in the mass range fall completely in the detection window at the rising edge of the TOF pulse. First, the gating pulse duration $\Delta t_1$ must be sufficiently short so that the physical length of the ion packet of $m_l$ is shorter than the detection window. This automatically ensures the same for an ion packet of $m_h$, given a constant kinetic energy. Second, ions require a certain length of time to travel from the exit lens to the TOF acceleration region, and ions of different masses take different lengths of time. Lighter ions travel with greater velocities and arrive at the acceleration region earlier than heavier ions. Consequently, at any point in time after the falling edge of the gating pulse, the ion packets for the various ions are dispersed in space and the degree of such dispersion increases with time. By proper selection of the time delay $\Delta t_{21}$ ions of $m_l$ leaving the source at the falling edge of the gating pulse would barely reach the exit of the detection window at the rising edge of the TOF pulse, while ions of mh leaving the source at the rising edge of the gating pulse pass the entrance of the detection window. In this way, 100% sampling duty cycle can be obtained in the mass range of m1 to mh.

An electric potential that is just right for ions to escape the axial potential well-inside the ion trap can be applied to the exit lens to release ions which are otherwise trapped when this potential is raised. This leads to small dispersion in ion kinetic energy. Also, there is a time lag focusing and ion-bunching effect associated with the trap-and-release operation; that is, ions leaving the source first acquire lower kinetic energy than ions leaving at the moment before the ion gate is pulsed to a high potential. The faster ions, initially farther from the acceleration region, catch up to the slower ions and the ion pulse becomes shorter.

Figure 7:
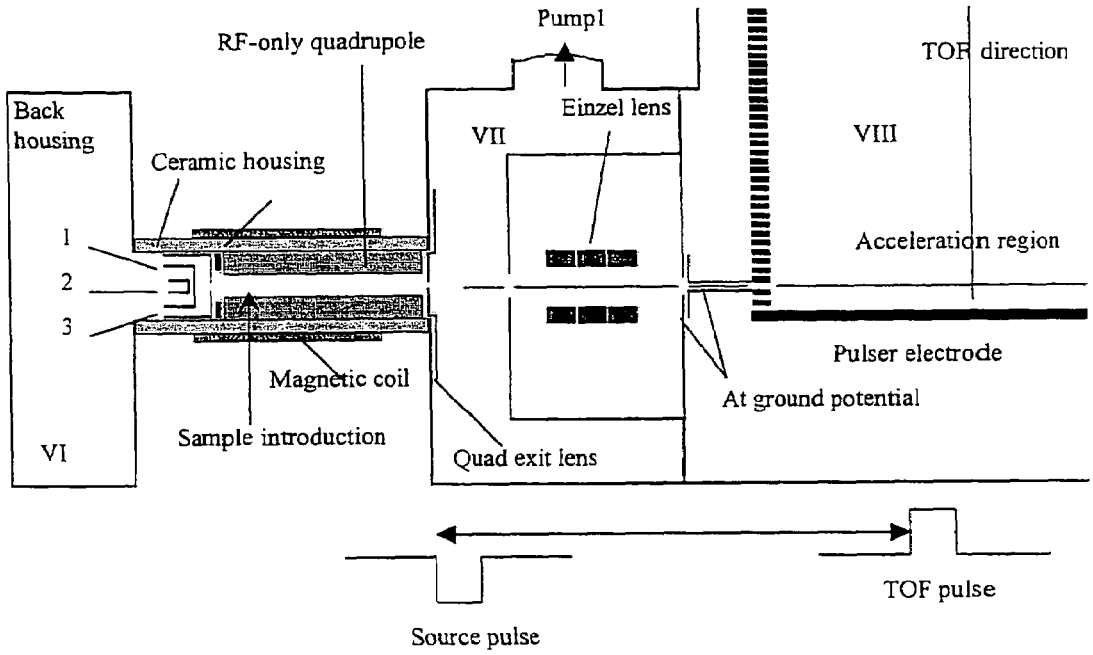
FIG. 7 is a schematic diagram of the EI source and the acceleration region of an orthogonal acceleration TOFMS.

A schematic diagram of the EI source and the acceleration region of an orthogonal acceleration TOFMS that is relevant to this description is shown in FIG. 7. The core element of the new source includes a ceramic tube (22.2 mm o.d., 15.9 mm i.d., 114.3 mm long) in which four quadrupole electrodes (stainless steel, 6.35 mm diameter, 75.2 mm long) and an electron gun (FRA-2x1-2/EGPS-2x1, Kimball Physics, Wilton, N.H.) are positioned. Straight cylindrical quadrupole rods are used for simplicity (i.e., a linear axial field is not considered here). A commercial electron gun is used to produce ionizing electrons. The electron gun uses a space-charge-limited refractory cathode disc instead of a filament to generate an electron beam in a planar triode design. The cathode was specially designed for low energy spread. An additional acceleration grid at more positive voltage with respect to the filament enhances the electron beam current at low energies. The electron gun has an exit aperture of 1.5 mm in diameter.

The ceramic tube is held between a back housing and an adapter plate with appropriate o-ring groove structures that function as a vacuum housing. The quadrupole rods are fixed inside the ceramic tube by self-sealing screws with o-rings. In such a way to achieve a 3.2 mm inscribed radius. The RF voltages are applied to the quadrupole through these screws. The electron gun is positioned 1 mm away from the entrance end of the quadrupole using a ceramic spacer. The electron gun body serves also as the quadrupole entrance lens and the ion repeller in the ion source. The leads from the electron gun are connected to a multiple pin connector on the back housing. An exit lens with an aperture of 1 mm in diameter is supported on the adapter plate and positioned 1 mm from the exit end of the quadrupole. The surface of the ceramic spacers and the inner surface of the ceramic vacuum housing are screened from electron and ion beams by the electrodes. The sample is introduced through a specially made fitting, orthogonal to the quadrupole axis at a distance of 3.2 mm from the quadrupole entrance.

An electromagnetic solenoid consisting of approximately 150 windings per centimeter is wound around the ceramic tubing close to the entrance lens using polyimide-coated magnetic wire (34.5 gauge) that can withstand up to 240° C. When operated with a moderate DC current of 1 A (Tenma. 72-2010), it produces approximately 200 gauss magnetic field in the middle part of the coil on the quadrupole axis. The field decreases longitudinally close to the ends of the coil and increases radially close to the inner surface of the coil. Resistance heating of the magnetic coil can heat the source up to 120° C. A temperature sensor is used to monitor and maintain the source at 120° C. through active cooling by a fan. A permanent magnet would be a better choice to provide high field strength and independent temperature control.

A 1.86 MHz RF driver module with DC offset capability is used to apply RF voltages to the quadrupole, and an oscilloscope is used to measure the RF voltage. Typically, the filament is electrically heated and biased at −50 V while the acceleration grid is set at −38 V. A positive 50 V is applied to the electron gun body, leading to electrons accelerated to 100 eV upon leaving the electron gun. The quadrupole rods are biased at +20 V so that electrons enter the quadrupole possessing about 70 eV energy. A voltage of −50 V is applied to the exit lens in a continuous ion beam mode. All DC and RF voltages are independently controlled.

The source can be operated in a trap-and-pulse mode so that ions can be trapped most of the time and released over a short period of time into the acceleration region. A delay generator triggered by the TOF pulses is used to gate a high voltage pulser (DEI, GRX-1.5K-E), which applies the trapping and extraction voltages to the exit lens. In this way, the EI source pulsing is synchronized with the TOF pulses. Separate control over the extraction pulse duration and delay time is available. In order to achieve a high sampling duty cycle over a large mass range, the release pulse duration and the delay time before each TOF pulse are optimized so that all ions of interest can be accommodated in the detection window exactly at the moment of the next TOF pulse. The mass scale must be recalibrated from the reference time used by the data acquisition system due to the introduction of a delay before the TOF pulse.

Only electrons entering the quadruple are responsible for ion generation. The effective electron beam current $I_{eff}$ is controlled by a heating DC current and the voltage settings of the electron gun. The effective beam current was obtained by subtracting the electron current measured on the grid and the entrance lens from the total emission current, which were monitored by three multimeters at the same time. $I_{eff}$ was approximately 10 μAmps with a filament heating current of 1.5 A.

An orthogonal acceleration TOFMS was used for to evaluate the new source design of the present invention. The original API interface was removed and the new source was retrofitted ahead of the einzel lens housing as shown in FIG. 7. In normal MS operation, a continuous ion beam from the source passes through the einzel lens assembly and a small aperture on the flight tube to fill the acceleration region during the loading period. During this period, the electric field in the acceleration region is set at ground potential. Then, appropriate voltages are applied to both the pulser electrode and field-defining electrodes to accelerate ions into the flight tube until the next loading period. At the same time, ions are stopped from entering the acceleration region. Ions in the flight tube are accelerated to about 4000 eV by the time they strike the multi-channel plate (MCP) detector.

Both the acceleration region and the flight tube are constructed from printed circuit boards and consist of a series of field-defining electrodes. Appropriate voltages to these electrodes define a parabolic field of an inverted perfectron which provides theoretically infinite-order correction for flight times of ions that have different starting positions. This design produces excellent resolution per effective unit length (m/Δm, about 3000), such that the use of a reflectron is often not necessary. A reasonable resolution can be obtained in a mass range of 30–1200 amu.

No grids are used in either the acceleration region or the flight tube. The gridless design provides close to 100% ion transmission through the flight tube. However, the instrument uses a long TOF pulse duration of about 65 μseconds for a pulsing frequency of 5 kHz (200 μs for one transient mass spectrum) which corresponds to an upper m/z limit >6000 amu. Ions cannot be loaded before the heaviest ions in the previous ion package reach the detector to avoid spectral overlapping. Unfortunately, the ion beam still overfills the acceleration region between TOF pulses (e.g., most of the ions pass through the pulsing region and are neutralized on the walls). This is especially true for low m/z ions. A sampling duty cycle of about 20% can be achieved for high m/z ions. A multi-anode ion counting system provides high detection efficiency and extends the dynamic range of the instrument. The instrument is one of the most sensitive mass analyzers, and would be more sensitive if the sampling duty cycle could be further improved.

With regard to the vacuum system, the electron gun requires a low conductance limit in the ceramic tube, while the exit lens has high conductance. Thus, the instrument requires three vacuum stages: VI in the back housing, VII in the quadrupole section of the ceramic tube and the einzel lens housing, and VIII in the flight tube. Stages VI and VIII can be monitored by vacuum gauges and VII is principally the same as VI under steady state conditions. With the original pumping system (one backup rotary pump, two turbo-molecular pumps, and no pump connected to the back housing), the pressure in the flight tube chamber and back vacuum housing are approximately $3\times10^{-7}$ mbar and $4\times10^{-5}$ mbar, respectively, for air (although, the gauge is calibrated for nitrogen) without additional gas addition.

Two high current power supplies are controlled manually (RF drive and filament). All other voltages are controlled by the SprayTOF operating software of the TOFMS. The SprayTOF program is also used to control the TOF instrument and record mass spectra. The software can also process raw spectral data online or offline and prepare calibration curves for quantitation. In these experiments, selected ion chromatograms from a selected range of m/z over time are exported to MS Excel to calculate signal-to-noise ratios and to prepare calibration curves.

In all experiments described in this section, time-of-flight mass analysis was used to determine the m/z values and abundances of the ions present. A Faraday plate detector (copper plate of 2.0 cm in diameter) was temporarily installed after the quad exit lens to measure the total ion current from the source with a pico-ammeter. A bias voltage could be applied to the Faraday plate to collect all ions emerging from the exit lens.

Because only electrons entering the quadruple are responsible for ion generation, the effective electron beam current $I_{eff}$ is defined as the emission current minus the total current measured on the focusing grid and electron gun body. The electron gun body serves also as the quadrupole entrance lens and, thus, the voltage applied to it is used as reference voltage for setting voltages on the filament and the focusing grid. In this way, the entrance lens voltage can be adjusted for efficient ion extraction, independent of the operation of the electron gun.

First, the $I_{eff}$ is affected by the grid voltage as referenced to the bias voltage on the filament, the heating DC current, and the ionizing electron kinetic energy. The curve of $I_{eff}$ versus grid voltage has a maximum due to the interaction between the increased emission current and increased loss on the grid. The $I_{eff}$ is also affected by the vacuum conditions and the magnetic field. The magnetic field increases the $I_{eff}$ with a decrease in emission current through reducing the electron loss on the focusing grid and electron gun body. With the voltage settings given in the previous section, the $I_{eff}$ was approximately 10 μamps with a DC heating current of 1.5 A.

The electrostatic field inside the quadrupole affects the trajectories of both electrons and ions. The simulation in FIG. 5(*a*) shows field penetration on both ends, and essentially no axial field in the middle section along the axis of the straight cylindrical rods. Field penetration depth is only determined by the physical geometry and the potential differences between the rod DC offset and the entrance or exit lens. By increasing the potential differences, the penetration depth increases slightly. With geometry used here, the fringing field penetrates about 6 mm into the quadrupole from each end using the voltage settings given in the previous section. A positive voltage on the entrance lens with respect to the DC offset of the quadrupole aids ion extraction by imposing an axial fringing field, although only in the vicinity of the entrance. However, for ions near the axial center of the quadrupole, this field is very weak and inefficient. Similarly, a negative potential on the exit lens behaves in the same way. Thus, in the presence of background gas, an axial field is necessary to move ions through the quadrupole.

Figure 8:
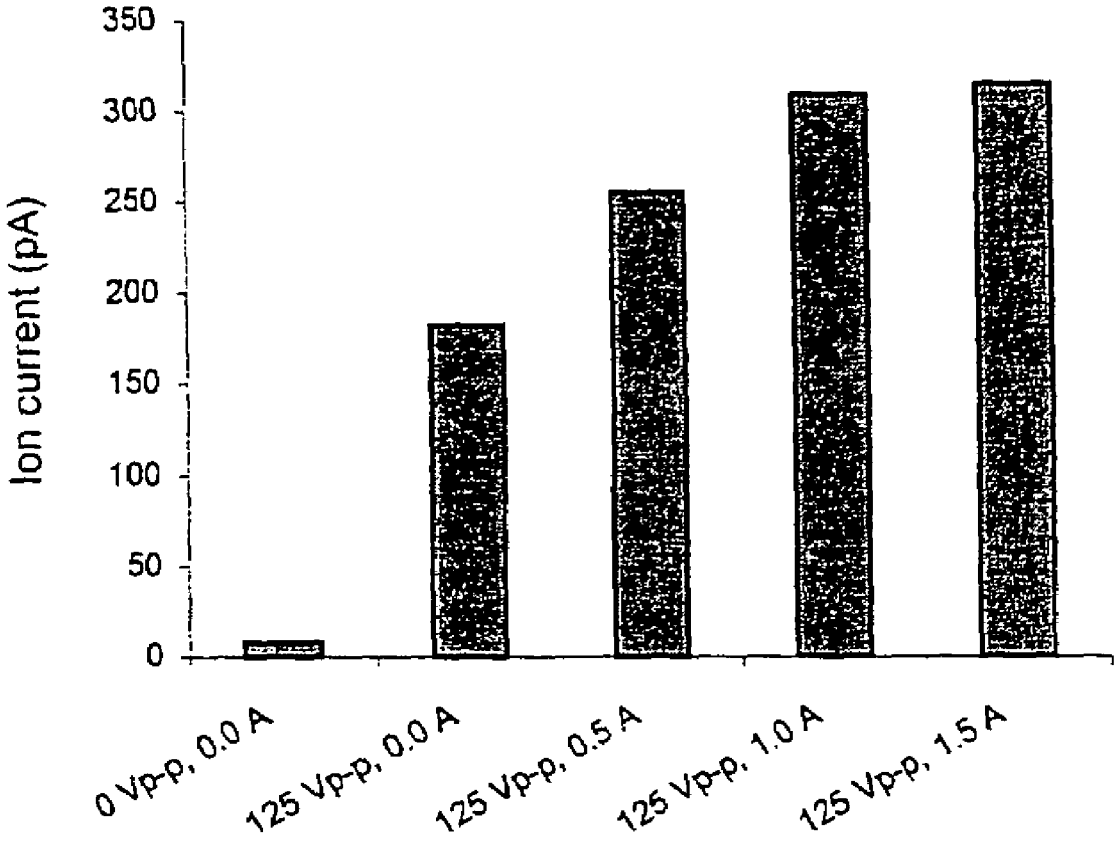
FIG. 8 is a graph illustration total ion current as a function of current through a magnetic coil.

The performance of the source was first evaluated by measuring the total ion current of residual air using the Faraday plate. A total ion current of >300 pA was recorded with a 9.6 A effective electron beam current and vacuum conditions described in the Experimental section (FIG. 8). The RF voltage and magnetic field greatly increased the total ion current. When the current was increased through the magnetic coil, a subsequent increase in ion current indicated that (1) more electrons were guided into the quadrupole and (2) electrons could penetrate at greater depth, leading to a larger ionization volume. At even higher current, the ion current leveled off, limited by the number of electrons that were available. The enhancement of the MS signal was similar to that observed using the Faraday plate detector.

Figure 9:
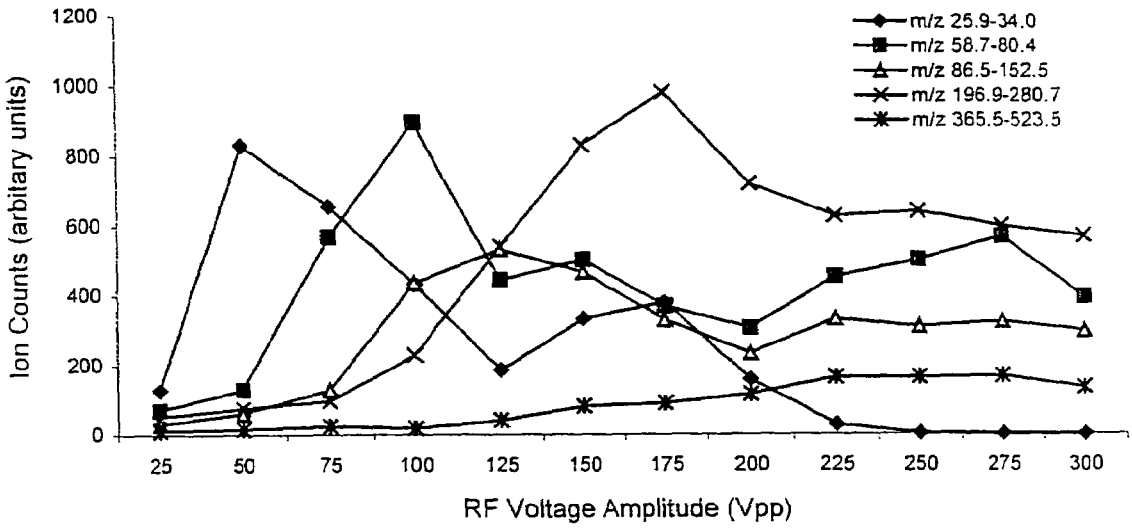
FIG. 9 is a graph of typical transmission characteristics.

An important factor in radial focusing of the ion beam is the role played by the amplitude of the RF voltage. An RF-only quadrupole ($a_M$=0) serves as a high-pass filter. Low m/z ions (corresponding to $q_M \geqq 0.908$) are unstable, and cannot pass through. There is no sharp cutoff for high m/z ions, and their transmission suffers at low RF voltage due to poor focusing because the depth of the effective potential well is inversely proportional to ion mass. The transmission characteristics were first studied by introducing PFTBA into the source through a leak valve. A steady partial pressure of PFTBA was maintained without additional gas. The signal intensities of ion groups of different m/z ranges were determined with increasing RF voltage. The results are shown in FIG. 9, indicating typical transmission characteristics.

With high RF voltage, low m/z ions are completely cut off. Higher RF voltage is required to cut off higher m/z ions. Signals of high m/z ions continue to increase with RF voltage because of better focusing, but eventually become constant at an RF voltage that is high enough to transmit all ions.

It is advantageous to operate the source at elevated pressure (1 mTorr) because ion losses in the radial direction are lower due to collisional focusing, and the relaxed vacuum requirements facilitate coupling of the source to various separation methods. In order to study the effect of source pressure on ionization and transmission processes, helium was introduced into the ion source to increase the source pressure independently from sample introduction. Helium was bubbled through n-butyl benzene in a sample vial at 0.21 mL/min and 25° C. before entering the EI source. n-Butylbenzene (m/z 134), which is commonly used as an energetic thermometer in mass spectrometry, may dissociate through two pathways in an EI source: a low energy McLafferty rearrangement resulting in m/z 92 ions ($C_7H_8^+$) or a higher energy pathway involving the loss of a propyl group to form m/z 91 ions ($C_7H_7^+$). The ratio of m/z 92 to 91 is used as a measure of the average internal energy transferred or acquired through collisions.

Figure 10:
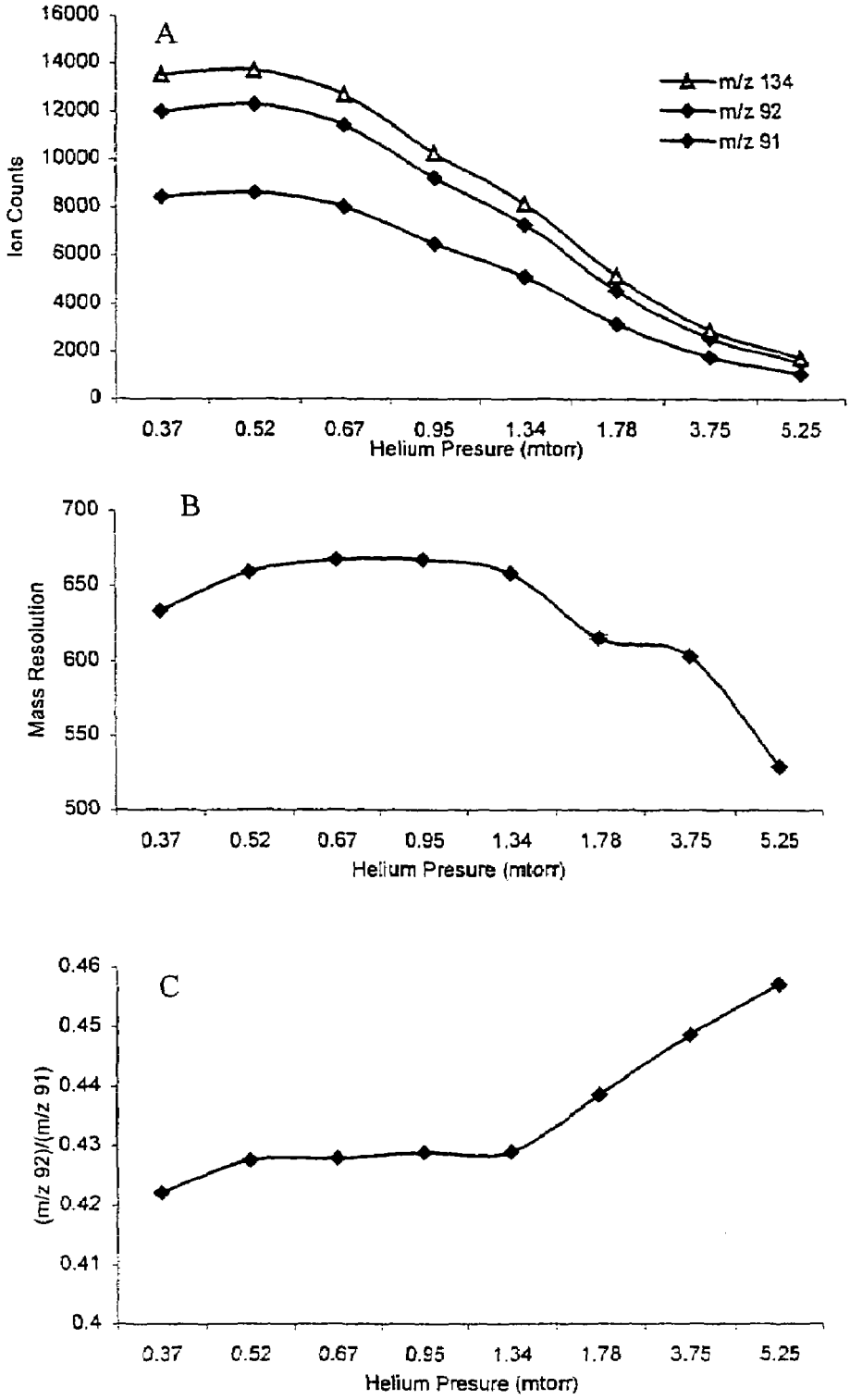
FIG. 10 is a series of graphs that illustrate the effect of source pressure on ionization and transmission processes.

The experimental results are illustrated in FIG. 10. The highest signal intensities for m/z 91, 92 and 134 are observed at 0.52 mtorr helium pressure in FIG. 10(*a*), and ion intensities then decreased with helium pressure. The optimal mass resolution is shown at about 0.9 mtorr in FIG. 10(*b*). It is suggested by the optimal signal intensity and mass resolution at elevated helium pressure that collisional focusing occurs in the source. This is consistent with observations using an ion trap in which the optimal sensitivity and mass resolution were found at approximately 1 mtorr helium pressure. It is also possible that ions formed inside the quadrupole source possess low kinetic energy, both radial and axial, and collisional focusing takes place at a lower pressure for high ion transmission efficiency while further increased ion-gas collisions lead to more ion losses in the region between the exit lens and the acceleration region.

Increased ion source pressure may also lead to charge exchange and chemical ionization (CI). In FIG. 10(*c*), the ion intensity ratio of m/z 92 to m/z 91 ions from n-butylbenzene is plotted against helium gas pressure. It is clear that helium pressure has little effect on the ratio below 1.34 mtorr. With higher helium pressure, it increases almost linearly. This can be explained by charge exchange between helium ions and n-butylbenzene molecules. The molecular ions formed then follow a low energy fragmentation pathway to m/z 92 ions, possibly involving collisions with helium gas as in collision-induced dissociation (CID). No signs were observed for chemical ionization in an experiment with 2-octanone. 2-Octanone is a compound known for self-CI. At high concentration, the ion ratio 129/128, (M+H)/M, can be larger than 1 if molecular ions stay long enough inside the ion source, such as in a quadrupole ion trap with internal ionization. Protonated molecular ions were not present in spectra acquired using high concentration.

Figure 11:
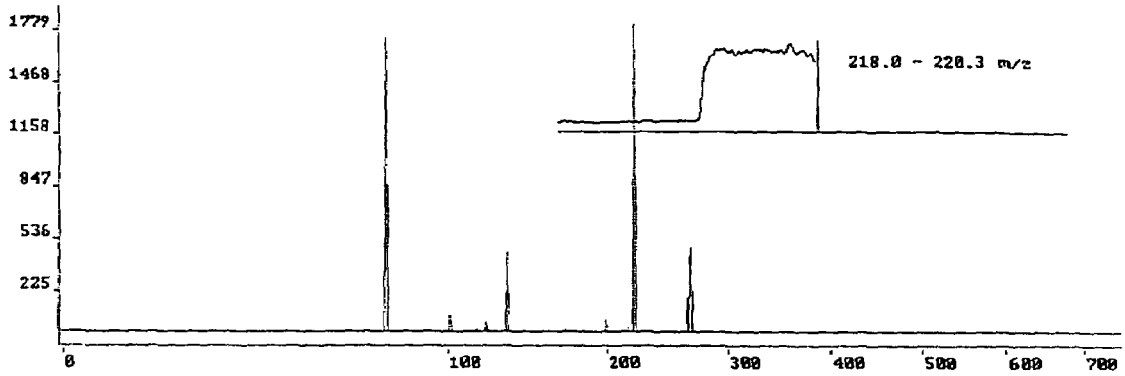
FIG. 11 shows a comparison of an EI spectrum of PFTBA obtained using a continuous ion beam with spectra recorded using pulsed extraction.
Figure 11:
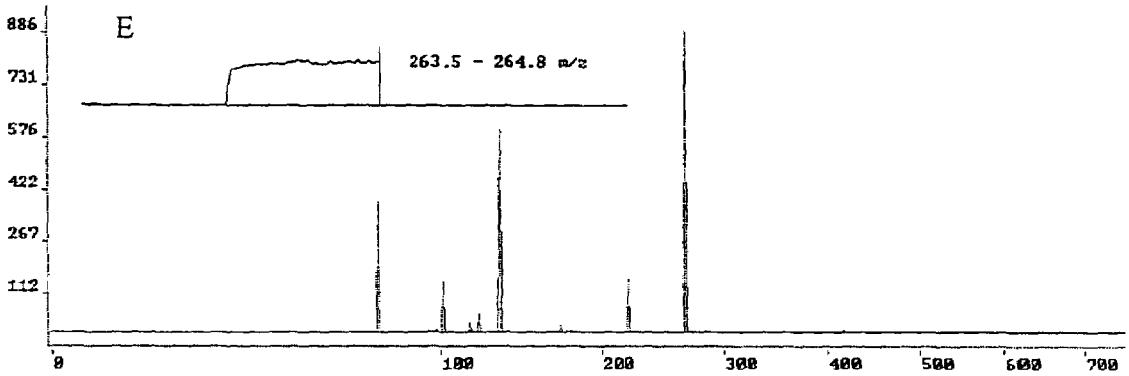

FIG. 11 shows a comparison of (a) an EI spectrum of PFTBA obtained using a continuous ion beam with spectra recorded using pulsed extraction optimized for (b) m/z 69, (c) m/z 131, (d) m/z 219, and (e) m/z 264 ions, respectively. The y-axis of each spectrum represents the ion counts recorded in 0.33 second (i.e., summing 1600 transients with 5 kHz TOF pulse frequency). The insert chart with every spectrum compares the summed ion count over unit mass as indicated, first using a continuous ion beam and then changing to pulsed extraction. For example in FIG. 11(*b*), the timing conditions (pulse duration and delay time) were optimized for m/z 69 ions, and factors of 13 and 33 were gained for peak area and peak height, respectively. Only m/z 69 ions were recorded in this spectrum. Higher m/z ions required a longer time to leave the source and reach the acceleration region. It is clear and reasonable to use longer pulse duration and delay times for higher m/z ions. With higher m/z ions, a larger mass range was observed, although with a smaller gain in peak area.

The timing conditions and signal intensity gains are also summarized in Table II. The gain factors were 8 to 45 times for peak area and 26 to 81 times for peak height. This also suggests significantly improved mass resolution (data not given here). The signal gain factors result from improved sampling duty cycle in orthogonal acceleration. The narrower peak width is possibly due to time lag focusing and ion bunching. It is also possible that ion extraction by charge repulsion is greatly improved because of the increased space charge inside the quadrupole due to trapping potential. Only those ions that happen to be near the exit lens at the time when the voltage is switched are affected by the extraction pulse, considering short field penetration into the quadrupole.

Several advantages other than those mentioned previously were observed using pulsed extraction. Chemical noise is reduced dramatically because unwanted ions are prevented from reaching the detector by source pulsing. Second, a particular mass range can be precisely selected by controlling the timing conditions as in FIG. 11(*b*) for m/z 69 ions. Moreover, the most intense mass peaks in the mass spectrum often originate from chemical species in the sample gas which are of no interest in the analysis, such as from the GC carrier gas and solvent. The dynamic range of orthogonal acceleration TOFMS can be increased by source pulsing to cover the mass range of interest while completely eliminating or obtaining a low sampling duty cycle for interfering peaks.

Figure 12:
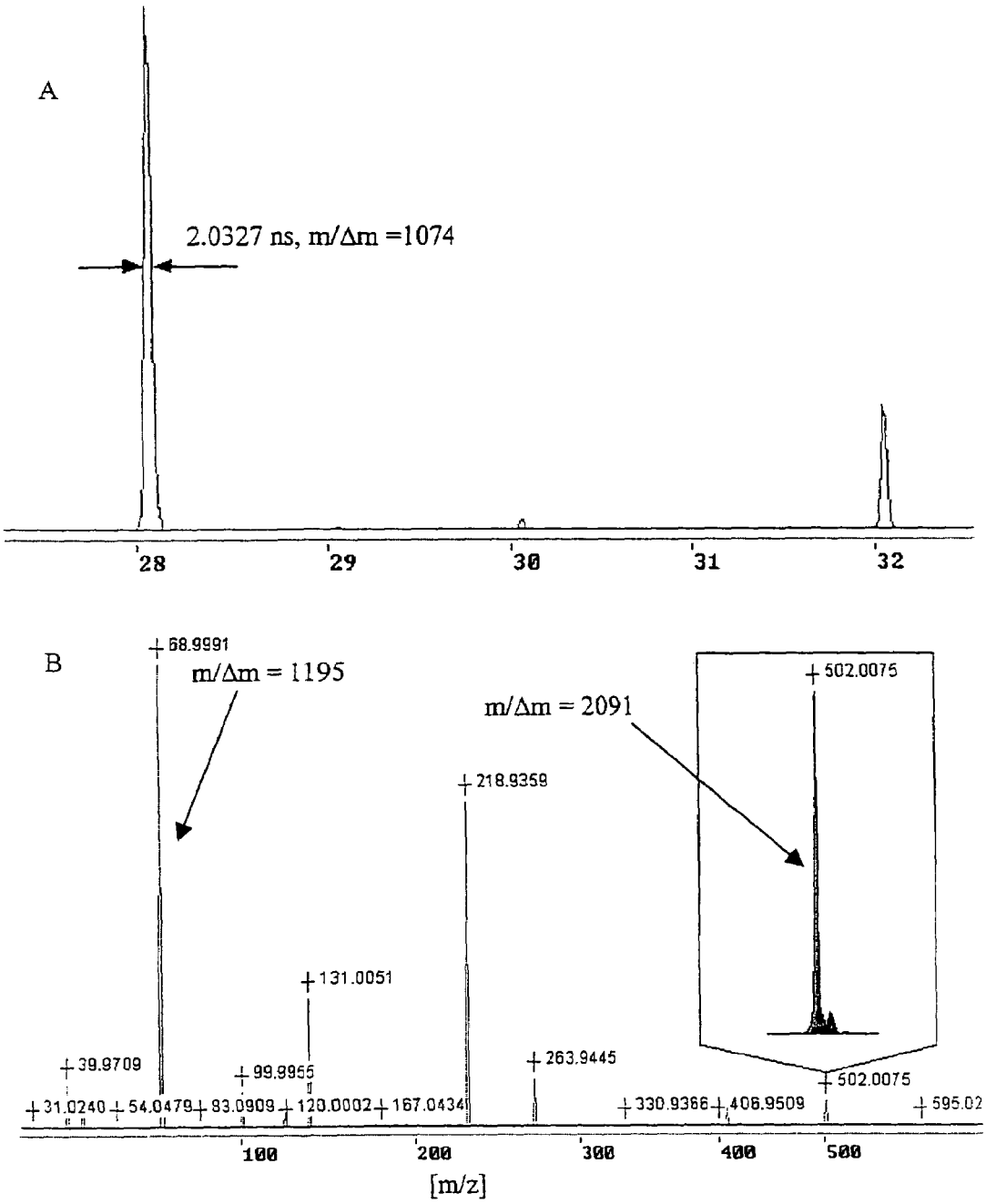
FIG. 12A is a graph illustrating a mass spectrum of residual air.
FIG. 12B is a graph illustrating a mass spectrum of PFTBA.

The fragmentation patterns and isotopic ratios in mass spectra produced by the new EI source are consistent with spectra in the NIST library. Experiments have been performed with chemicals including butylbenzene, 2-octone, normal alkanes, and PFTBA. Little discrepancy was observed with all of these compounds. A mass spectrum of PFTBA is shown in FIG. 12(*b*). The qualitative fragmentation pattern of PFTBA is as predicted, however, the relative intensities of individual fragment ions are greatly affected by the RF voltage amplitude, electrostatic voltage settings, and source pulsing. Importantly, the source vacuum conditions have little or no effect on the relative intensities of ions. As a matter of fact, the PFTBA spectrum shown in the accurate mass format actually favors high m/z Ions.

The expanded mass spectrum of residual air is shown in FIG. 12(*a*). This represents the summation of 200 spectra at a TOF pulsing frequency of 5 kHz. A mass resolution of 1074 for m/z=28 indicates that the ion source produces a well-collimated ion beam. In the summed PFTBA spectrum in FIG. 12(*b*), mass resolutions of 1195 and 2090 were obtained at m/z 69 and 502, respectively. An increase in mass resolution with m/z due to a longer flight time indicates that the peak width is mainly determined by the detector response and electronics.

Overall instrument performance for sensitivity and detection limits was tested by coupling the instrument to a gas chromatograph. An 8 m long, 0.1 mm i.d. (0.2 μm film thickness) DB-5 column (J&W) was used with a helium flow rate at 150 kPa and temperature programming from 25° C. to 95° C. at 70° C./min. A 0.5 μL sample volume in hexane was injected using the split mode with a split ratio of 1:550. This sample volume and the split ratio had to be used with the present equipment in order to avoid overloading the column and to obtain sufficient chromatographic efficiency. The heated transfer line was held at 50° C. and the EI source at around 100° C. The effective electron beam current was increased to 15 μA and the filament was turned off during solvent elution between 36 and 48 seconds. The source exit was pulsed with a duration time of 4 μs and a delay time of 12 μs in order to cover the mass range of interest. Data were acquired at 12 spectra/s (5 kHz TOF pulsing frequency and 400 transient summation). Other instrumental parameters were 2550 V for the MCP detector and 2023 V for the detection threshold set by the SprayTOF software.

Figure 13:
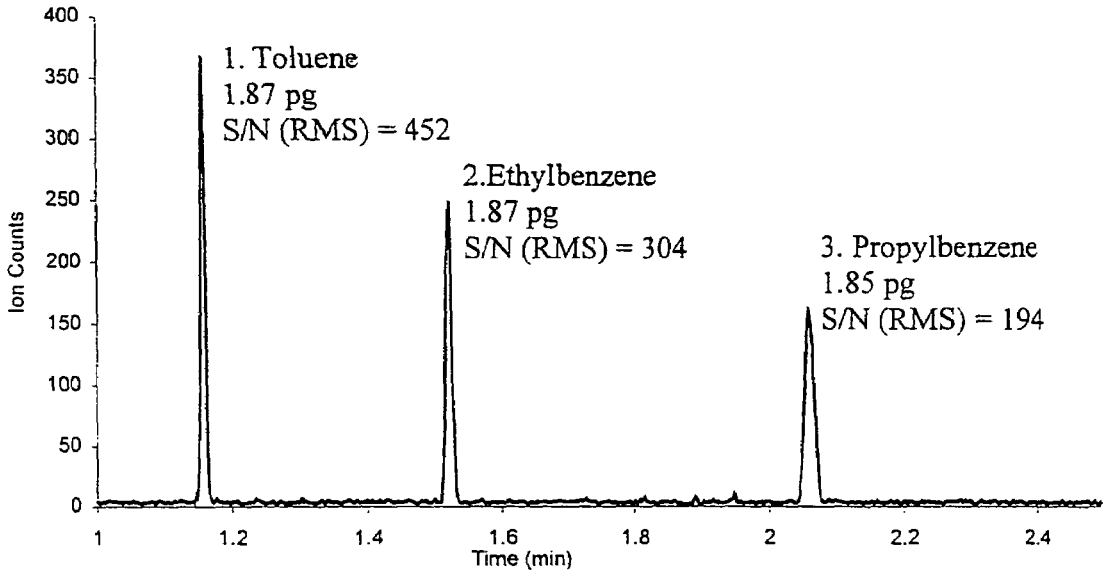
FIG. 13 is a graph that demonstrates the sensitivity and detection limits for toluene, ethylbenzene, and propylbenzene.

FIG. 13 demonstrates the sensitivity and detection limits for toluene, ethylbenzene, and propylbenzene. These analytes were chosen because of transfer line and source heating problems. The chromatogram shown is a reconstruction obtained by extracting m/z 90.9–91.2 from data acquired in the full spectrum mode. A signal-to-noise ratio (S/N peak height to root-mean-square RMS noise) of 452 was obtained for 1.87 pg of toluene, 304 for 1.87 pg of ethylbenzene, and 194 for 1.85 pg of propylbenzene on-column. The limits of detection (LOD) by linear extrapolation using a peak-to-peak noise criterion (2.8 RMS noise) were 12 fg, 17 fg, and 27 fg, respectively. Intensive fragmentation of sample analytes and excessive background chemical noise were observed. It is anticipated that these results can be greatly improved if source heating is available and the high chemical noise is eliminated.

It is to be understood that the above-described arrangements are only illustrative of the application of the principles of the present invention. Numerous modifications and alternative arrangements may be devised by those skilled in the art without departing from the spirit and scope of the present invention. The appended claims are intended to cover such modifications and arrangements.

TABLE I

| Vpp (V) | Phase angle | B (Gauss) | Δt (ns) | L (mm) | KE (eV) |
|---|---|---|---|---|---|
| | | | 15.7 | 78 | 70 |
| 200 | 0 | | 11.0 | 55 | 83 |
| 200 | 30 | | 4.0 | 18 | 121 |
| 200 | 60 | | 3.0 | 14 | 157 |
| 200 | 90 | | 3.0 | 13 | 167 |
| 200 | 90 | 500 | 16.5 | 78 | 72 |

TABLE II

| | m/z 69 | m/z 131 | m/z 219 | m/z 264 |
|---|---|---|---|---|
| Extraction duration (μs) | 1.0 | 2.4 | 3.6 | 4.4 |
| Delay time (μs) | 9.6 | 14.0 | 20.0 | 22.5 |
| Peak area improvement | 13 x | 34 x | 8 x | 45 x |
| Peak height improvement | 33 x | 81 x | 26 x | 65 x |

What is claimed is:

1. A method for providing an improved ionization source, said method comprising the steps of:

(1) providing an ion guide for delivering ions;

(2) providing electron confinement that operates in conjunction with the ion guide, wherein the electron confinement is superimposed around and co-axial with a long axis of the ion guide, and wherein electron confinement is provided by using a symmetrical magnetic field to compress and guide a beam of electrons along the long axis; and (3) creating ions in an ionization volume.

2. The method as defined in claim 1 wherein the method further comprises the step of providing an improved electron ionization source.

3. The method as defined in claim 1 wherein the method further comprises the step of providing an improved chemical ionization source.

4. The method as defined in claim 1 wherein the method further comprises the step of performing collisional focusing of ions along the long axis of the ion guide to obtain enhanced ion delivery.

5. The method as defined in claim 1 wherein the method further comprises the steps of providing a radio-frequency ion guide, wherein the radio-frequency ion guide can be operated using alternating current or alternating voltage.

6. The method as defined in claim 1 wherein the method further comprises the step of disposing the symmetrical magnetic field so as not to be in co-axial alignment with the long axis of the ion guide.

7. The method as defined in claim 1 wherein the method further comprises the step of using the symmetrical magnetic field to confine an electron beam derived from an electron source along the long axis of the ion guide.

8. The method as defined in claim 1 wherein the method further comprises the step of maintaining a narrow energy distribution of electrons within the ion guide.

9. The method as defined in claim 1 wherein the method further comprises the step of prolonging interaction of electrons, charged compounds, and uncharged compounds within the ion guide by means of application of the symmetrical magnetic field.

10. The method as defined in claim 1 wherein the method further comprises the step of using a cylindrical structure to generate the symmetrical magnetic field.

11. The method as defined in claim 10 wherein the step of using a cylindrical structure further comprises the step of using a single cylindrical structural element.

12. The method as defined in claim 10 wherein the step of using a cylindrical structure further comprises the step of using a cylindrical structure comprised of a plurality of discrete structural elements.

13. The method as defined in claim 12 wherein the step of using a cylindrical structure comprised of discrete structural elements further comprises the step of using a plurality of magnetic elements.

14. The method as defined in claim 1 wherein the method further comprises the step of using at least one permanent magnet to generate the symmetrical magnetic field.

15. The method as defined in claim 1 wherein the method further comprises the step of using at least one electromagnet to generate the symmetrical magnetic field.

16. The method as defined in claim 1 wherein the method further comprises the step of providing a radially confining radio-frequency (RF) field as the ion guide.

17. The method as defined in claim 16 wherein the method further comprises the step of selecting the radially confining RF field from a group of ion guides comprised of a singular pole, a quadrupole or any other multi-pole arrangement, a stack of electrodes, a stack of lenses, and an ion trap.

18. The method as defined in claim 17 wherein the method further comprises the step of selecting the electron source from a group of electron sources or beta emitters comprised of an electron gun, a hot filament, a discharge needle, or by radioactive decay of an appropriate material.

19. The method as defined in claim 1 wherein the method further comprises the step of delivering the ionization volume to a mass analyzer to thereby improve sensitivity thereof.

20. The method as defined in claim 1 wherein the method further comprises the step of delivering the ionization volume to a mass analyzer to thereby improve detection limits thereof.

21. The method as defined in claim 1 wherein the step of creating the ions in the ionization volume further comprises the step of delivering the ions to a desired target.

22. The method as defined in claim 21 wherein the method further comprises the step of selecting the target from the group of targets comprised of an ion mobility analyzer, a mass analyzer, and a secondary ion mass spectrometer.

23. The method as defined in claim 22 wherein the method further comprises the step of selecting the mass analyzer from the group of mass analyzers comprised of a time of flight mass analyzer, a quadrupole mass analyzer, a magnetic sector mass analyzer, an electrostatic sector mass analyzer, an ion cyclotron resonance mass analyzer, an ion trap, and a wein filter.

24. The method as defined in claim 22 wherein the method further comprises the step of selecting the ion mobility analyzer from the group of ion mobility analyzers comprised of a linear drift tube, an asymmetric waveform mobility analyzer, a differential ion mobility analyzer, and a cross-flow ion mobility analyzer.

25. The method as defined in claim 21 wherein the method further comprises the step of operating the ion guide in a pulse mode or a continuous stream mode.

26. The method as defined in claim 25 wherein the method further comprises the step of increasing a duty cycle of the mass analyzer.

27. The method as defined in claim 1 wherein the method further comprises the step of using the ions in the ionization volume to create secondary ions.

28. The method as defined in claim 1 wherein the method further comprises the step of using the ion guide and the electron confinement to thereby operate as a source of ions for other applications.

29. A system for providing an improved ionization source, said system comprised of:

an ion guide for delivering ions;

an electron confinement system that operates in conjunction with the ion guide, wherein the electron confinement system is superimposed around and co-axial with a long axis of the ion guide, and wherein electron confinement is provided by a symmetrical magnetic field to compress and guide a beam of electrons along the long axis; and an ionization volume.

30. The system as defined in claim 29 wherein the ionization source is further comprised of an electron ionization source.

31. The system as defined in claim 29 wherein the ionization source is further comprised of a chemical ionization source.

32. The system as defined in claim 29 wherein the system is further comprised of a radio-frequency ion guide, wherein the radio-frequency ion guide can be operated using alternating current or alternating voltage.

33. The system as defined in claim 32 wherein the system is further comprised of disposing the symmetrical magnetic field so as not to be in co-axial alignment with the long axis of the ion guide.

34. The system as defined in claim 32 wherein the system is further comprised of a cylindrical structure that is used to generate the symmetrical magnetic field.

35. The system as defined in claim 34 wherein the cylindrical structure is further comprised of a single cylindrical structural element.

36. The system as defined in claim 34 wherein cylindrical structure is further comprised of a plurality of discrete structural elements.

37. The system as defined in claim 36 wherein the cylindrical structure comprised of discrete structural elements is further comprised of a plurality of magnetic elements.

38. The system as defined in claim 32 wherein the system is further comprised of at least one permanent magnet being used to generate the symmetrical magnetic field.

39. The system as defined in claim 32 wherein the system is further comprised of at least one electromagnet being used to generate the symmetrical magnetic field.

40. The system as defined in claim 32 wherein the ion guide is further comprised of a radially confining radio-frequency (RF) field.

41. The system as defined in claim 40 wherein the system is further comprised of selecting the radially confining RF field from a group of ion guides comprised of a singular pole, a quadrupole or any other multi-pole arrangement, a stack of electrodes, a stack of lenses, and an ion trap.

42. The system as defined in claim 40 wherein the system is further comprised of selecting the electron source from a group of electron sources or beta emitters comprised of an electron gun, a hot filament, a discharge needle, or by radioactive decay of an appropriate material.

43. The system as defined in claim 29 wherein the system is further comprised of a mass analyzer, wherein the ionization volume is delivered thereto to thereby improve sensitivity thereof.

44. The system as defined in claim 29 wherein the system is further comprised of a mass analyzer, wherein the ionization volume is delivered thereto to thereby improve detection limits thereof.

45. The system as defined in claim 29 wherein the system is further comprised of a target, wherein the ions in the ionization volume are delivered to the target.

46. The system as defined in claim 45 wherein the system is further comprised of selecting the target from the group of targets comprised of an ion mobility analyzer, a mass analyzer, and a secondary ion mass spectrometer.

47. The system as defined in claim 46 wherein the system is further comprised of selecting the mass analyzer from the group of mass analyzers comprised of a time of flight mass analyzer, a quadrupole mass analyzer, a magnetic sector mass analyzer, an electrostatic sector mass analyzer, an ion cyclotron resonance mass analyzer, an ion trap, and a wein filter.

48. The system as defined in claim 47 wherein the system is further comprised of selecting the ion mobility analyzer from the group of ion mobility analyzers comprised of a linear drift tube, an asymmetric waveform mobility analyzer, a differential ion mobility analyzer, and a cross-flow ion mobility analyzer.

49. The system as defined in claim 48 wherein the ion guide is further comprised of having at least two operating modes, a first operating mode being a pulse mode, and a second operating mode being a continuous stream mode.

50. The system as defined in claim 47 wherein the system is further comprised of a means for creating secondary ions.

51. The system as defined in claim 29 wherein the system is further comprised of means for operating the ion guide and the electron confinement system as a source of ions for other applications.

52. A method for providing improved confinement of ions within an ionization volume, said method comprising the steps of:

(1) providing an ion guide for confining ions;

(2) providing electron confinement that operates in conjunction with the ion guide, wherein the electron confinement is superimposed around and co-axial with a long axis of the ion guide, and wherein electron confinement is provided by a symmetrical magnetic field to compress and guide a beam of electrons along the long axis; and (3) confining ions in an ionization volume.

53. The method as defined in claim 52 wherein the method is further comprised of a delivery system for releasing ions from the ionization volume at selectable intervals for pulsed ion delivery.

54. The method as defined in claim 53 wherein the method further comprises the step, of providing a radio-frequency ion guide, wherein the radio-frequency ion guide can be operated using alternating current or alternating voltage.

55. The method as defined in claim 54 wherein the method further comprises the step of using a cylindrical structure to generate the symmetrical magnetic field.

56. The method as defined in claim 55 wherein the step of using a cylindrical structure further comprises the step of using a single cylindrical structural element.

57. The method as defined in claim 55 wherein the step of using a cylindrical structure further comprises the step of using a cylindrical structure comprised of a plurality of discrete structural elements.

58. The method as defined in claim 57 wherein the step of using a cylindrical structure comprised of discrete structural elements further comprises the step of using a plurality of magnetic elements.

59. The method as defined in claim 58 wherein the method further comprises the step of using at least one permanent magnet to generate the symmetrical magnetic field.

60. The method as defined in claim 58 wherein the method further comprises the step of using at least one electromagnet to generate the symmetrical magnetic field.

61. A system for providing improved confinement of ions within an ionization volume, said system comprised of:

an ion guide for confining ions;

an electron confinement system that operates in conjunction with the ion guide, wherein the electron confinement is superimposed around and co-axial with a long axis of the ion guide, and wherein electron confinement is provided by a symmetrical magnetic field to compress and guide a beam of electrons along the long axis; and an ionization volume for confining ions.

62. The system as defined in claim 61 wherein the system is further comprised of a delivery system for releasing ions from the ionization volume at selectable intervals for pulsed ion delivery.

63. The system as defined in claim 62 wherein the system is further comprised of a radio-frequency ion guide, wherein the radio-frequency ion guide can be operated using alternating current or alternating voltage.

64. The system as defined in claim 63 wherein the system is further comprised of a cylindrical structure that is used to generate the symmetrical magnetic field.

65. The system as defined in claim 64 wherein the cylindrical structure is further comprised of a single cylindrical structural element.

66. The system as defined in claim 64 wherein the cylindrical structure is further comprised of a plurality of discrete structural elements.

67. The system as defined in claim 66 wherein the cylindrical structure comprised of a plurality of discrete structural elements is further comprised of a plurality of magnetic elements.

68. The system am defined in claim 61 wherein the system is further comprised of at least one permanent magnet to generate the symmetrical magnetic field.

69. The system as defined in claim 61 wherein the system is further comprised of at least one electromagnet to generate the symmetrical magnetic field.

* * * * *